US005725059A

United States Patent [19]

Kuckes et al.

[11] Patent Number: 5,725,059

[45] Date of Patent: Mar. 10, 1998

[54] METHOD AND APPARATUS FOR PRODUCING PARALLEL BOREHOLES

[75] Inventors: Arthur F. Kuckes, Ithaca, N.Y.; J. Gaenger; H. J. Bayer, both of Ettlingen, Germany

[73] Assignee: Vector Magnetics, Inc., Ithaca, N.Y.

[21] Appl. No.: 581,500

[22] Filed: Dec. 29, 1995

[51] Int. Cl.[6] ..... E21B 7/04; E21B 47/09

[52] U.S. Cl. ..... 175/45; 175/61; 175/62

[58] Field of Search ..... 175/45, 61, 62

[56] References Cited

U.S. PATENT DOCUMENTS

| | | | |
|---|---|---|---|
| 3,406,766 | 10/1968 | Henderson | 175/61 |
| 3,853,185 | 12/1974 | Dahl et al. | 175/45 |
| 3,907,045 | 9/1975 | Dahl et al. | 175/45 |
| 4,402,372 | 9/1983 | Cherrington | 175/53 X |
| 4,700,142 | 10/1987 | Kuckes | 324/346 |
| 5,074,365 | 12/1991 | Kuckes | 1775/40 |
| 5,343,152 | 8/1994 | Kuckes | 175/45 |
| 5,485,089 | 1/1996 | Kuckes | 175/45 X |
| 5,515,931 | 5/1996 | Kuckes | 175/45 |
| 5,589,775 | 12/1996 | Kuckes | 175/45 X |

FOREIGN PATENT DOCUMENTS

| | | |
|---|---|---|
| 4335290 A1 | 4/1991 | Germany . |
| WO94/11762 | 5/1994 | WIPO . |

OTHER PUBLICATIONS

"WieSieAltlasten eins auswachsenFlowmonta," by FlowTex Technologie Import von Kabelverlegemaschinen GmbH.

"Fondazioni Speciali".

*Primary Examiner*—Hoang C. Dang

*Attorney, Agent, or Firm*—Jones, Tullar & Cooper, P.C.

[57] ABSTRACT

A method and apparatus for steering boreholes for use in creating a subsurface barrier layer includes drilling a first reference borehole, retracting the drill stem while injecting a sealing material into the Earth around the borehole, and simultaneously pulling a guide wire into the borehole. The guide wire is connected to a source of current to produce a corresponding magnetic field in the Earth around the reference borehole while an adjacent borehole is drilled. The vector components of the apparent Earth's magnetic field are measured vectors are used to determine the distance and direction from the borehole being drilled to the reference borehole in order to steer the borehole being drilled. The process is repeated to provide multiple parallel subsurface boreholes with adjacent boreholes being spaced sufficiently close together to insure overlapping of the sealing material to produce a continuous barrier. The magnetic field used for guidance is also used for signalling the steering tool electronic probe for controlling its measurement program. The guide wire is also used for an antenna to receive telemetry signals for data being sent by the probe to the surface.

33 Claims, 4 Drawing Sheets

METHOD AND APPARATUS FOR PRODUCING PARALLEL BOREHOLES

BACKGROUND OF THE INVENTION

The present invention relates, in general, to an improved method and apparatus for underground drilling of generally horizontal boreholes, and more particularly to the use of such apparatus and of the method for producing an impervious membrane or barrier beneath the Earth's surface utilizing a multiplicity of such boreholes.

One of the major environmental hazards faced today is the long-term damage being caused by the leakage of dangerous or hazardous chemicals from improperly stored wastes, rubbish, and other hazardous material in dump sites throughout the world. These materials were often dumped without knowledge of, or concern for, the problems they might produce in the future, but it is now known that such materials can produce serious contamination of the soil and groundwater through diffusion leakage or spillage of materials into previously unpolluted regions. The danger to water supplies and to health in general presented by such sites is now resulting in a strong effort to seal off these sites and to rehabilitate them. However, present methods for sealing and remediation are extremely expensive, and in some cases such methods are not technically capable of solving the problem.

Numerous attempts have been made to devise methods and procedures for sealing hazardous waste sites. For example, one technique involves sinking a vertical mine shaft adjacent to the site, and then locating a plurality of "working" pipes under the site by drilling horizontally from the mine shaft. Thereafter, sealing material is injected into the Earth from the working pipes. However, such a technique is extremely expensive, and the mining techniques for installing the working pipes are suitable only for certain cases.

In another technique, a deep trench is dug around the waste site and a continuous sealing layer is driven under the site through a cut and injection method. This method requires perpendicular, protected vertical trench walls, and again is very expensive.

Another, more successful technique uses a measurement-while-drilling (MWD) method to produce multiple boreholes from the surface outside the waste site leading under the site. A liquid, gelatinous, and/or finely-divided solid sealing material is then injected into the Earth surrounding the borehole. However, MWD controls have not been sufficiently accurate to ensure that the boreholes will remain parallel, with the result that this process has not produced reliable sealing.

Accordingly, none of the foregoing techniques have been fully satisfactory. Not only are they technically complex and extremely expensive, they are not always successful, since methods using injection techniques are difficult to monitor, and anomalies in the ground or errors in drilling can leave voids. Thus, for example, when drilling boreholes, the drillers often cannot be certain of the exact location of the drill since accurate control of the drilling is difficult. Measurement of drill location through the use of surface wire controls have been unsatisfactory, since the precision of such techniques is only about 2% of the depth of the hole, even assuming that access to the surface above the borehole location is available. Attempts have been made to control the drilling of such boreholes through the use of telemetry wires located inside the drill stem, but such wires must be cut and spliced each time a new drill stem section is added. This is not only time consuming, but each splice degrades the electrical connection and is susceptible to breakage, adversely affecting the reliability of the control signals. Without precise control of the boreholes, the integrity of the sealing layer cannot be assured.

SUMMARY OF THE INVENTION

It is an object of the present invention to provide improved steering techniques for producing multiple subsurface, generally horizontal, parallel boreholes.

Another object of the invention is to utilize improved borehole steering techniques for producing parallel boreholes, and utilizing such boreholes in the formation of a subsurface sealing membrane in the Earth beneath an existing waste site which is to be contained, or encapsulated.

In accordance with the invention, multiple parallel subsurface boreholes are produced by drilling a first borehole generally horizontally through the Earth using conventional measurement while drilling or steering tool techniques to guide the drill. This initial borehole is started at the surface of the Earth at, for example, one side of a work site to be contained, and is drilled at an angle downwardly into the Earth, then is drilled generally horizontally beneath the site, and then is angled upwardly back to the surface. Precise control of this initial borehole is not critical, since its principal use will be as a reference for later-drilled holes.

When the drill exits the Earth on the far side of the site, a guide cable is attached to the end of the drill string, and the drill string is gradually retracted, or withdrawn, pulling the cable through the borehole to be used as a reference for drilling additional boreholes, as will be explained. When the boreholes are being used to produce a layer or membrane having low permeability for encapsulation, a sealing material is ejected from jet grouting nozzles on the drill head as the drill string is withdrawn. This sealing material may be ejected using the known "Flowmonta" process of FlowTex Technology Import von Kabelverlegemaschinen GmbH, of Ettlingen, Germany, described in German Patent DE 4335290. In accordance with this process, sealing material is ejected into the borehole at a high pressure, for example, 200 to 1,000 atmospheres, to pump the sealing material into the Earth around the borehole. Preferably, two nozzles are used, angled apart by about 10 to about 180 degrees and facing outwardly and generally downwardly toward the low side, or bottom of the borehole. In the Flowmonta technology the high pressure sealing material is injected, for example, in fan-shaped, overlapping patterns beneath and laterally to the sides of the borehole to produce a low-permeability layer in the Earth along the length of the borehole or along a part of the borehole length, as required. The drill string is held at a substantially constant rotational orientation as it is withdrawn so that the sealing material forms a layer beneath, and extending outwardly to the sides of, the borehole, as well as filling the borehole itself around the cable.

Preferably, the guide sealing material is natural montan wax which may be mixed, for example, with materials such as cement and bentonite, although other sealing materials can be used. The wax sets up to produce a flexible, low permeability layer which is resistant to chemicals and which can be easily repaired if damaged by settling of waste material or soil beneath the site, by earthquakes, or the like.

After the guide cable is in place in the borehole, it may be used as a reference for drilling additional boreholes. For this purpose it is connected to a source of direct current or of low frequency alternating current at one end, and is grounded at the opposite end. A current of about 10 amperes through the cable is used to produce a magnetic field surrounding the borehole in which the cable is located. This field is used to steer additional boreholes and to control a measurement program in a steering tool probe in the drill stem used to drill such additional boreholes. In addition, the cable serves as an antenna or transformer secondary winding to receive audio frequency electromagnetic telemetry signals transmitted by the electronic steering tool probe and to carry such signals to surface receiving equipment.

The electronic steering tool probe incorporated in the drill stem includes a sensor incorporating inclinometers and fluxgate magnetometers for use in spacially orienting the drill within the borehole being drilled and for sensing with precision the total magnetic field at that borehole, including the field generated by electric current in the cable in the reference borehole. Such measurements permit determination of the distance and direction from the borehole being drilled to the current-carrying guide cable in the reference borehole. Measurements of this distance and direction are taken periodically during drilling of the second borehole so that it is drilled precisely parallel to the reference borehole, i.e. within ±0.1 meter, and at a controlled relative depth. Thus, the second borehole may be drilled at the same depth as the initial hole, or may be a selected distance above or below it.

Upon completion of the second borehole, another guide cable may be connected to the end of the drill at its exit location to be pulled through the second borehole as the drill string is withdrawn, as sealing material is injected into the Earth surrounding this borehole. The second guide cable may then be connected to the current source and the process repeated for a third and for subsequent boreholes. In each case the subsequent borehole is drilled using cable current in a previous borehole as the reference. Alternatively, if the boreholes are sufficiently close together it may not be necessary to place a guide cable in each borehole; instead, cables might be placed in alternate holes or in every third hole, for example, as long as the magnetic field produced by the current in a reference borehole guide cable is sufficient to provide accurate distance and direction measurements.

In most instances, the drill used in the present invention may be a water jet drill which utilizes high pressure water to produce a borehole. Air or foam drilling fluids may also be used. When the boreholes are used to provide a low permeability membrane under a waste site, for example, boreholes of about 76 mm in diameter are drilled, starting at one side of the waste site and passing as far below the waste site as is desired. The hole being drilled preferably is sufficiently deep that the membrane to be formed will catch, or encapsulate, hazardous materials seeping from the waste site to prevent their entry into the underground water table, for example. In a test of the present invention, a plurality of side-by-side, parallel boreholes were drilled to depths of over 7 meters below the surface and with a length from the entrance location to the exit location of over 100 meters. Adjacent holes were spaced apart one to three meters center-to-center, and were drilled with a precision of plus or minus 100 mm when using the guidance system of the present invention. The jet grouting process produced a low permeability wax layer having a minimum thickness of approximately 75 mm at and between the boreholes, with the fan-shaped injections from adjacent boreholes producing an overlap that provided a continuous, low permeability barrier membrane. The success of the test was monitored by excavation after the process was performed.

Although the drilling technique of the present invention for producing parallel, closely spaced multiple boreholes is described herein in conjunction with a preferred process and apparatus for producing low permeability subsurface layers which may be used, for example, to contain toxic materials in landfills and waste sites, nevertheless, it will be understood that the present invention can be used for a variety of applications. The invention thus can be used generally for the injection construction of underground barriers, for example in tunnel construction to secure the leading roof, to secure the working level for elongated deep excavation in a groundwater region, to separate different ground water levels by closing hydraulic short circuit holes, for improving the subsoil in deeper-lying horizons or for monitoring drillings after injections. Other applications are the construction of parallel shallow wells, the parallel laying of lines (cables), the parallel laying of measuring instruments, the parallel mounting of rock anchors or the parallel arrangement of rock relieving bores such as empty bores, frac bores, or draining bores, as well as High Pressure Injecting, Jet Grouting and Permeation Grouting.

BRIEF DESCRIPTION OF THE DRAWINGS

The foregoing, and additional objects, features and advantages of the present invention will be apparent to those of skill in the art from the following detailed description of a preferred embodiment of the invention, taken in conjunction with the accompanying drawings, in which.

DESCRIPTION OF PREFERRED EMBODIMENT

Figure 1:
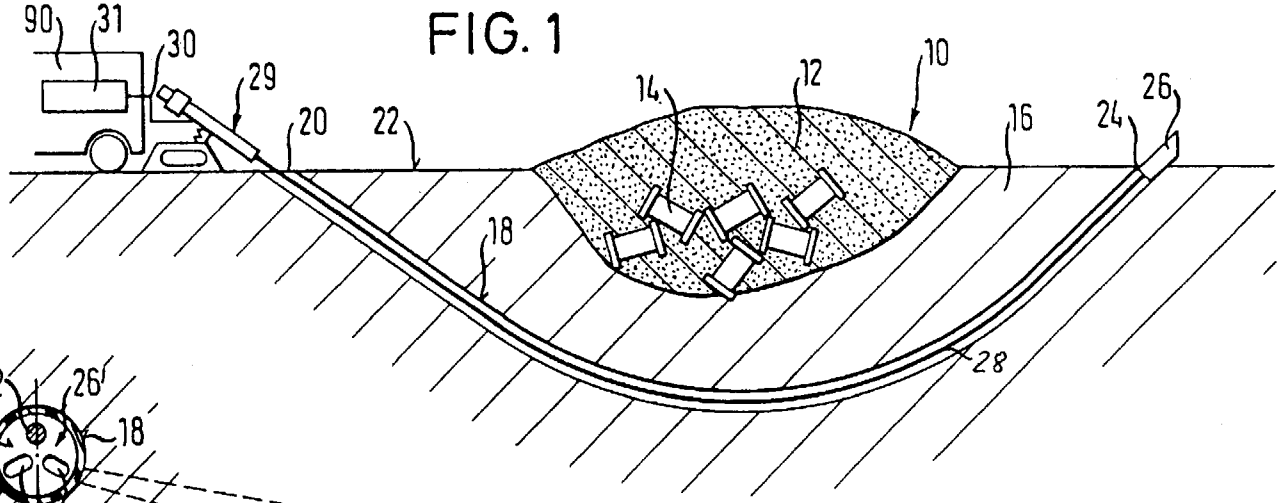
FIG. 1 is a diagrammatic illustration of a borehole drilled under a waste site in accordance with the Flowmonta process and the present invention.
Figure 2:
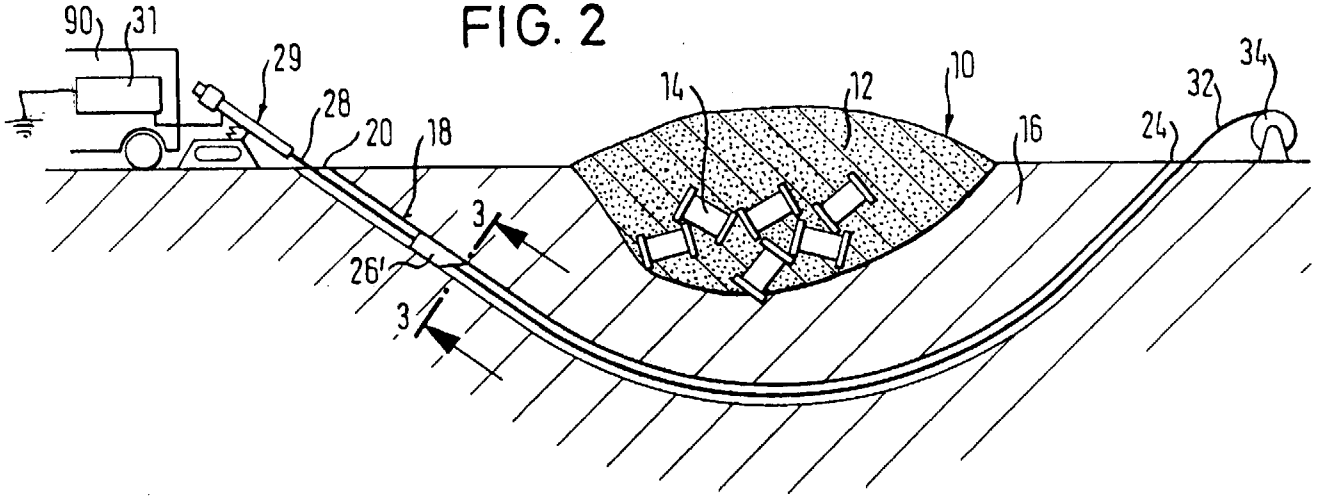
FIG. 2 is a diagrammatic illustration of the borehole of FIG. 1 with the drill string partially withdrawn and connected to a guide cable.

Turning now to a more detailed description of the invention there is illustrated in FIG. 1 a waste location, or dump site 10, containing, for example, hazardous material 12 which may include storage drums 14 containing dangerous chemicals or the like either on the surface of the Earth 16 or buried in the Earth. A low permeability, generally horizontal barrier is placed beneath the waste site 10 by drilling a plurality of generally horizontal, parallel boreholes under the site. As illustrated, a first borehole 18 extends from an entrance location 20 in the Earth's surface 22 on one side of the waste site 10, generally downwardly and then generally horizontally beneath the waste site, the borehole then curving generally upwardly to an exit location 24 at the surface 22 of the Earth. It will be understood that this first borehole may follow any desired path, with the illustrated path being only exemplary.

The borehole 18 may be drilled by means of a conventional water jet drill comprising a drill head 26 connected to a sectional steel drill stem 28. The drill stem is supplied by conventional drilling equipment 29 located at the surface near entrance 20, where sections of drill pipe are connected to the end of the drill stem, as needed, during the drilling of the borehole. Each pipe section may be, for example, 5 meters in length, with drilling being stopped every 5 meters to permit addition of a new section to the stem. The stem may include conventional measurement and control equipment near the drill head 26 so that during the time the drilling is stopped, location measurements and calculations can be made and directional control signals can be sent downhole to control further drilling. As is conventional in water drilling, water under pressure is supplied at the drilling equipment 29 and flows through the drill stem 28 to drilling head 26, where the water exits through suitable high pressure water jet nozzles (not shown) for drilling.

The initial borehole 18 preferably is drilled utilizing conventional borehole steering tool techniques, wherein a sensor incorporating a fluxgate magnetometer is located at or near the drilling head to measure the Earth's magnetic field. The sensor may also incorporate inclinometers to determine the orientation of the drill head. Output signals from the magnetometers and the inclinometers are transmitted to the surface in known manner; for example, using an umbilical wire (not shown) extending through the drill stem 28 and connected way of suitable wiring 30 to surface equipment 31 including receiver telemetry and a computer for calculation of the location of the drill head 26 and for determination of the direction of further drilling. Directional control signals are then transmitted downhole through the umbilical wire to provide steering instructions for the drill. The initial hole is drilled under the waste site 10 at a sufficient depth to pass completely under it and under any significant accumulation of hazardous liquids or other material in the Earth beneath the waste site, as illustrated, with the borehole continuing to the exit location 24 where it pierces the surface 22 and becomes accessible.

When the drill head exits the Earth at location 24, a guide cable 32, which may be conventional armored cable, is attached to the head 26 and the drill stem 28 is then withdrawn from the borehole 18 by the drilling equipment 29. As the drill stem is withdrawn, the cable 32 is drawn, as from a reel 34, into and through the borehole 18.

When the borehole is being used to provide a low permeability layer, a grouting material is injected into the borehole, and thus into the Earth surrounding the borehole, at the same time the cable 32 is drawn into the borehole. For this purpose, when the drill head 26 exits the Earth at location 24, a grouting head 26' is attached to the drill stem in place of the drillhead. Alternatively, the existing head 26 is modified as by plugging the water jet apertures used for drilling and by opening grouting jet nozzles. A sealing material such as naturally occurring montan wax, which is a fossil plant wax, or montan wax in combination with cement and bentonite, or other suitable sealing material, is then injected into the Earth through the grouting nozzles in the drilling head as the drill stem is withdrawn. The grouting material is injected at a very high pressure; for example, between 200 and 1,000 atmospheres, and is injected into the Earth from the borehole.

Figure 3:
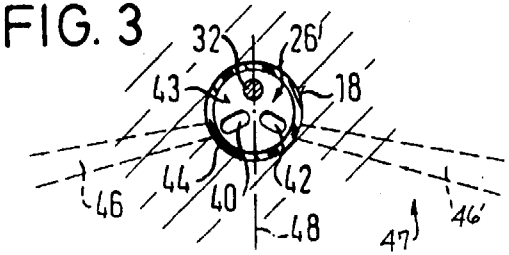
FIG. 3 is a cross-sectional view of a borehole taken along 3—3 of FIG. 2.

FIG. 3 illustrates an end view of grouting head 26' incorporating a pair of injectors or grouting nozzles 40 and 42 on the face 43 of the head, the nozzles diverging at an angle of, for example, between 60 and 120 degrees. The high pressure of the grouting material forces grout 44 into the Earth in thin, fan-shaped streams 46 and 46' to a distance of, for example, 2 meters from the center of the borehole 18 to form a continuous barrier layer generally indicated at 47. The orientation of the grouting head 26' is controlled during withdrawal of the drill string so that the nozzles 40 and 42 are directed generally outwardly and downwardly and diverge substantially equally on opposite sides of a vertical plane 48 passing through the center line of the borehole. The grout forms a barrier layer 47 in the Earth which spreads outwardly to each side of the borehole approximately equal distances, and extends lengthwise along the borehole from the exit location 24, beneath the waste site 10, to the entrance location 20.

Figure 4:
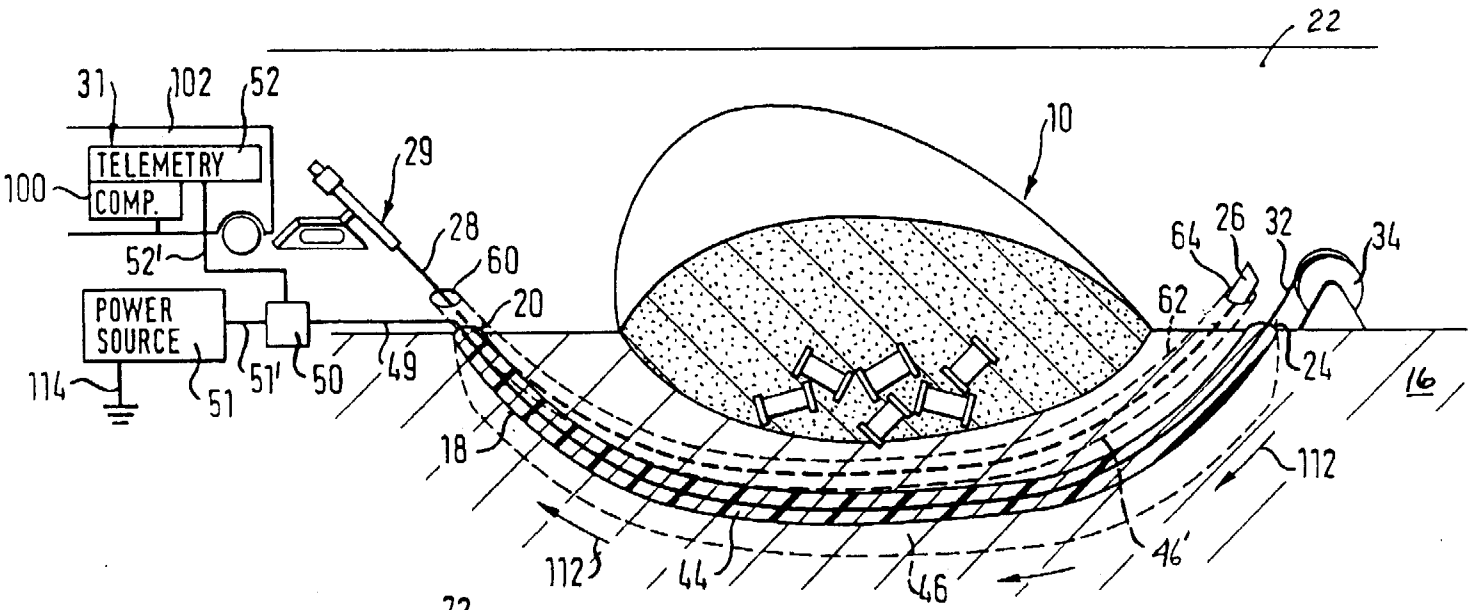
FIG. 4 is a diagrammatic perspective illustration, partially cut away, of two side-by-side boreholes drilled under a waste site.

As illustrated in FIG. 4, upon complete withdrawal of the drill stem 28 from borehole 18, the cable 32 is detached from the drill head 26 or 26' and is electrically connected by way of line 49 to a switch 50. The switch connects line 49 and thus cable 32 to a source 51 of direct current or low frequency alternating current by way of line 51' and/or to a telemetry receiver 52 in the surface equipment 31 by way of line 52'. The end of the cable at the exit end 24, is then connected to ground potential, as illustrated at 54 in FIG. 6. Alternatively, the exit end is connected by a distant return wire 55 shown in dotted lines (see FIG. 6) back to the current source 51. This leaves the cable 32 extending through the borehole 18, and in the illustrated embodiment, also leaves the borehole filled with sealing material 44 (see FIG. 4). The Earth beneath and to either side of the borehole includes the inverted V shaped layer of sealing material 47 described above to thereby form a low permeability barrier layer (see FIG. 3). Although the barrier layer is illustrated as extending generally below and to the sides of the borehole in FIG. 3, it will be understood that the material may also, or alternatively, flow generally upwardly and outwardly above the borehole 18 and to the sides, depending upon the soil conditions, the pressures used, and the orientation of the grouting nozzles 40 and 42.

Figure 5:
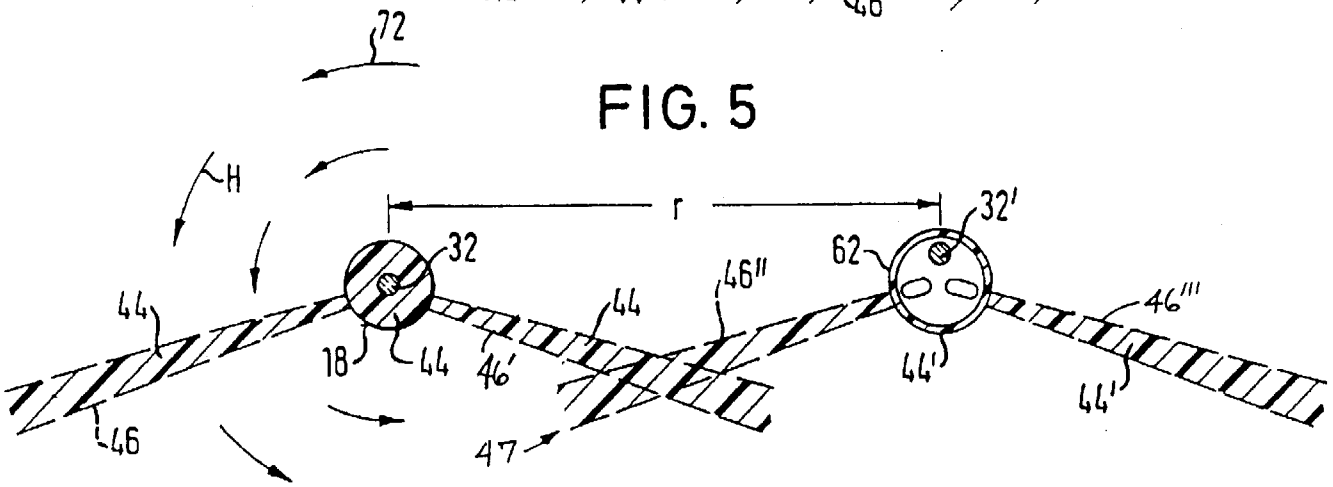
FIG. 5 is a diagrammatic cross sectional view illustrating a completed borehole and an adjacent borehole being drilled.

When it is desired to drill additional boreholes near to, and parallel to, borehole 18, the cable 32 in borehole 18 is used for three purposes. First, the DC or low frequency AC guide current supplied by source 51 generates a circular magnetic field around the cable 32 which can be detected by the steering probe of a nearby drill. This field is used during the drilling of an adjacent or nearby borehole to determine the location of the steering tool probe for the adjacent borehole relative to the cable and to guide the drilling. Second, the cable 32 is also used for sending control signals to the nearby steering tool probe to control the probe measurement program; e.g., to turn the probe telemetry on and off to conserve battery power, to signal the probe to cause it to send tool face data, to signal it to send full or partial survey information, or the like. The third function of the cable is to serve as an antenna, or as a secondary winding to of a transformer, to receive audio frequency digitally encoded telemetry signals representing measurements made by the probe and which are to be sent by the steering tool probe to the telemetry receiver 52 at the surface. Accordingly, when a subsequent borehole is to be drilled parallel to the initial, or reference borehole 18, the drilling equipment 29 is moved to a second entrance location; for example, the location 60 adjacent to location 20. If the parallel borehole is to be used to extend the barrier layer 47, she location 60 will be spaced away from the reference borehole by a distance r (FIG. 5) of a little less than twice the lateral sealing extent of the barrier material 46 or 46'. The adjacent borehole 62 is then guided to be parallel to reference borehole 18, so that when sealing material is injected into the second borehole, as will be described, the sealing material will intersect with the material injected from the first borehole to produce a continuous barrier layer between the boreholes (FIG. 5).

More particularly, the drillhead 26 is operated in the manner described with respect to FIG. 1 to drill the second borehole 62 (FIGS. 4 and 6) so that it, too, extends downwardly and beneath the waste site 10. Borehole 62 exits the Earth's surface at an exit location 64 on the far side of the site from the equipment 29. The direction of the second borehole and its location with respect to the first borehole is carefully and accurately controlled in accordance with the present invention so that the boreholes are parallel, and are at the desired relative depths to insure that no voids will be left in the barrier layer formed by the adjoining layers 46, 46'. When borehole 62 has been completed, the nozzle 26 is then modified or changed, as discussed above, to permit injection of sealing material, and if desired, a second cable is attached to the drillhead 26 or 26'. This second cable, illustrated at 32' in FIG. 5, is drawn through borehole 62 as the drill string 28 is withdrawn, while at the same time sealing material 44' is injected into the borehole 62 and into the Earth beneath and to the sides of the borehole, as illustrated at 46" and 46'". If the optional cable 32' in this second borehole is used, then upon completion of this second borehole, the cable 32' is electrically connected to a power supply such as source 51 and to receiver telemetry 52, as discussed above for cable 32.

Thereafter, a third borehole 70 (FIG. 6) may be drilled adjacent to and parallel to borehole 62 in the same manner as borehole 62, with sealing material being injected into the Earth as the drill stem is withdrawn to further extend the barrier layer 47. Additional parallel boreholes are provided at the desired depths and with the desired lateral spacing, in the manner illustrated in FIG. 6, along the entire length of the waste site 10 and extending under its entire width to thereby produce a continuous, low permeability barrier under the entire waste site.

The cable or guide wire 32, which is pulled through the initial, or reference borehole 18 in the manner described above, is utilized both as a reference guide wire and as a telemetry antenna for drilling one or more subsequent boreholes. Similar guide wires 32' such as that illustrated in FIG. 5, may be pulled through selected later-drilled boreholes, in the manner illustrated in FIG. 6 for alternate boreholes. Each guide wire is useable as a reference to insure that subsequent adjacent boreholes are closely parallel and that they are at substantially the same depth to ensure that the injection of sealing material will produce a continuous barrier.

In accordance with the invention, as illustrated in FIGS. 4–9, the cable 32 and each of the subsequent cables 32' in turn, is used as a reference for guiding the drilling of adjacent boreholes by directing a D.C. guidance current of, for example, 10 amperes through the cable 32 to produce a surrounding magnetic field H, illustrated by arrows 72 in FIG. 5. The direction of drilling of borehole 62 is controlled in response to measurements of this field H, as described above, by adjusting the direction of the drilling jets in the drilling head 26 under the control of a conventional drill steering tool 78 located in a drill control package 79. This package is mounted immediately behind the drilling head in a section 28' of the drill stem separated from the main stem 28 by an insulating joint 80 (see FIGS. 7 and 8). The insulating joint may be located 5 to 10 meters from the forward end, or tip, of the drilling head 26 and electrically insulates the end section 28' of the drill stem from the main, or upper portion of the stem 28.

The package 79 receives drill control information from the surface, and supplies downhole data to the surface. Accordingly, the package 79 includes a sensor and controller probe 81 which incorporates, in addition to steering tool 78, a magnetic field sensor 82 which preferably is a three-axis fluxgate magnetometer for measuring the vector components of the total static magnetic field (including applied field H) along orthogonal x, y, and z axes. If a low frequency AC guidance current is used in the reference cable, a separate AC magnetometer sensor, which may be a single coil having multiple turns, is connected to a low power amplifier with the AC sensor measuring the alternating magnetic field at the probe. The probe 81 also includes a pair of inclinometers 83 for measuring the direction of the Earth's gravity to orient the drill stem in space.

Transmission of the measured parameters to the surface is accomplished by supplying output signals from the sensor 81, corresponding to the measured vector components of the magnetic field and to the measurements from the inclinometers, to a transmitter which includes an analog-to-digital converter 84 connected by way of line 85 to an associated digital data telemetry modulator 86. Modulator 86 generates phase modulated currents at about 200–2400 Hz which encode the digitized data from probe 81 and supplies these currents through transformer 88 to a secondary winding 90 connected between drill stem 28 and drill stem portion 28' through lines 92 and 94. The encoding scheme described in the EXAR Corporation Databook, published by EXAR Corporation of San Jose, Calif., at page 2–335 (Application Note AN-01 on stable FSK Modems) shows a convenient accepted protocol for doing this. The encoded output current flow from modulator 86 produces a voltage across insulating joint 80 and a resulting modulated audio frequency current, indicated by arrow 96 in FIG. 8, along a long portion of the drill stem 28, 28', with this current having a return flow in the Earth surrounding the drill stem.

Figure 7:
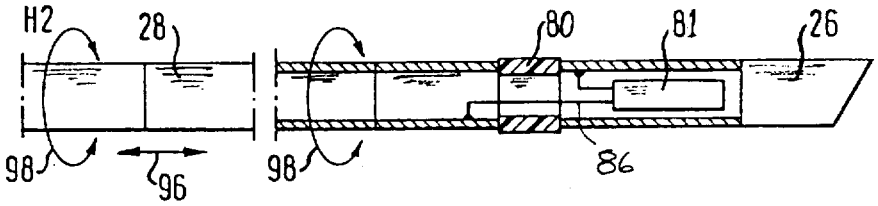
FIG. 7 is a diagrammatic illustration of a drill stem utilized in drilling the boreholes of and the present invention and incorporating a steering tool electronic probe.
Figure 8:
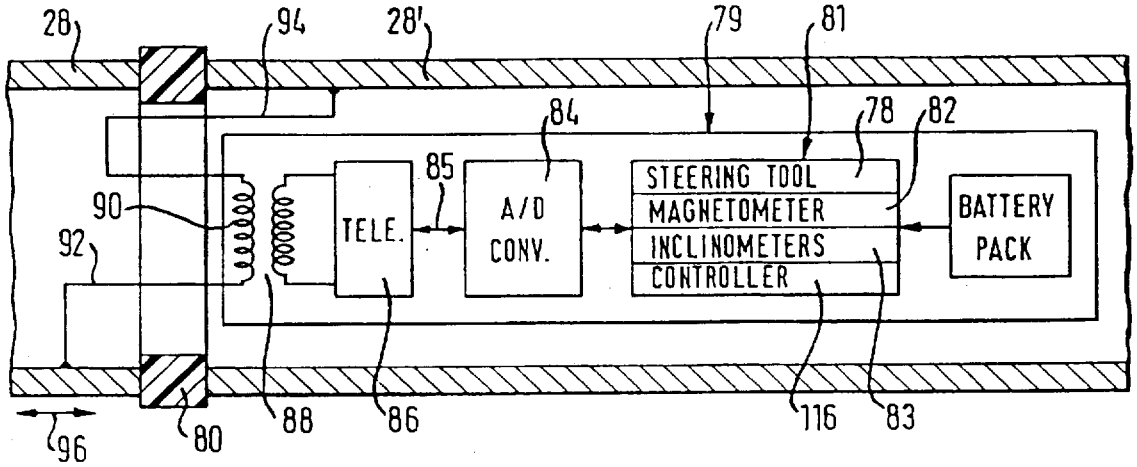
FIG. 8. is a diagrammatic illustration of the steering tool electronic probe utilized in the drill stem.

The modulated current 96 in the drill stem generates a corresponding circular alternating magnetic field, indicated by field lines H2 and illustrated by arrows 98 in FIG. 7, which is coaxial with the drill stem 28. This AC magnetic field H2 is inductively coupled to the neighboring guide cable 32 with the cable acting as a single-turn secondary winding of a transformer, or as a receiving antenna, to generate a corresponding audio frequency voltage V2 which is supplied by way of line 49, switch 50, and line 52' to the telemetry transmitter/receiver (or transceiver) 52 and its included demodulator/modulator (FIG. 4). The received audio frequency signals are supplied by the transceiver 52 to the demodulator, which produces an output which is supplied to a suitable computer 100 (FIG. 4). The computer then decodes the digitized data and carries out the necessary calculations, as will be described. It has been found that with a modulated current 96 of approximately 0.2 ampere in drill stem 28, a voltage V2 of approximately 0.1 volts can be generated at the surface. For convenience, the surface telemetry (or transceiver) 52 and computer 100 can be housed in a vehicle such as truck 102 for positioning adjacent the guide wire being used as the reference and communications link.

The computer calculates from the received data the distance and direction from the probe 81 to the reference cable 32, and determines what corrections, if any, in drilling direction are required. The required drilling instructions are then transmitted to the probe 81 for controlling the steering tool 78. Thus the driller uses the information from the probe 81 to maintain the borehole 62 on a path which is spaced a constant distance r (FIG. 5) from the guide cable 32 so that it follows a path which is parallel to cable 32 within a very close tolerance.

Figure 6:
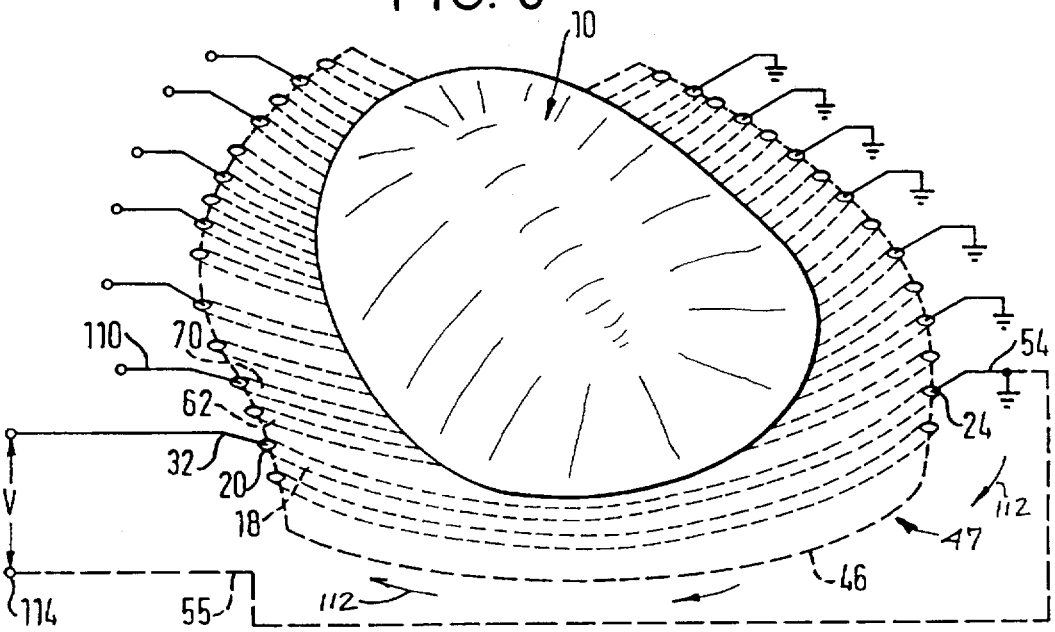
FIG. 6 is a diagrammatic perspective view of a waste site having a plurality of boreholes forming a barrier therebeneath.

Depending upon the strength of the magnetic field H, it may be possible to drill a third borehole, such as the borehole 70, using the guide field produced by cable 32 in the reference borehole 18, making it unnecessary to pull a guide cable through borehole 62. In this case, the borehole 70 would be drilled while maintaining a constant distance r' from borehole 18, and in the preferred embodiment of the invention, upon completion of drilling, a second guide cable 110 would be pulled through borehole 70 as sealing material is injected into that borehole. Furthermore, it may be possible to use the same reference magnetic field 72 from cable 32 to drill additional boreholes, in which case the next reference guide cable may be placed in every third or fourth borehole. Thus, selected boreholes are provided with guide cables connected at one end to a source of power and at the opposite end to ground for use in guiding later-drilled boreholes until the multiplicity of precisely-spaced boreholes illustrated in FIG. 6 is complete.

The magnetic field H produced by a guide current, for example in cable 32, is superimposed on the Earth's magnetic field as well as on any other magnetic fields in the region of sensor 81. Thus, the field H is subject to perturbations caused by the Earth's magnetic field, by various anomalies in the area where the boreholes are being drilled, and by magnetic fields caused by return ground currents 112 from the ground point 54 (FIG. 6) to a ground point 114 at the power source 51. These ground currents are also illustrated in FIG. 4. Perturbations due to the Earth's magnetic field can be compensated for by measuring the Earth's field with the magnetometer during drilling, or by periodically reversing the power supply 51 and measuring the field H. Thus, the field H is first measured with the current flowing in a first direction for a period of time (for example, 2 seconds) and then the current is reversed and the magnetic field is again measured. The Earth's field values needed for conventional surveying information are then obtained by averaging the fields measured during the two directions of current flow and the magnetic field values H due to current flow on the guide cable 32 are obtained by taking the differences of the magnetic field vector values component by component. Alternatively, if AC current is used to excite the cable one simply takes the AC magnetic field values. Perturbations due to ground currents 112 can be avoided by connecting the return line 55 at a location which is spaced far enough away from cable 32 as to have little or no effect on the magnetic field in the hole being drilled.

The distance and the direction from the drill package 81 to the nearby reference cable are determined by computer 100 using mathematics which is well known by those proficient in the art. If a grounded system is used to provide a path for return currents 112, compensation for magnetic fields caused by the ground currents can be provided in accordance with the following vector equation:

$$H=\frac{IQ}{2\Pi r}+I\left(\frac{1}{4\pi d1}+\frac{1}{4\pi d2}\right)x$$

where I is the current flow through the guide wire, d1 is the distance from the sensor 81 to ground point 114, d2 is the distance from the sensor 81 to the guide wire ground point 54, Q is the directional unit vector of the field produced by a current I in the guide cable, and x is the effective directional vector of the field produced by the ground current 112. The greater the distances d1 and d2, the smaller will be the effects of the ground currents at the magnetic field sensor in instrument package 79. If the ground points 54 and 114 are at least about 100 meters from the borehole ends 20 and 24, the effects of the ground currents on the value of H will be negligible for a 2 meter separation between the boreholes. The foregoing mathematical explanation is further described in U.S. application Ser. No. 08/341,880, filed Nov. 15, 1994, of Arthur F. Kuckes, now the U.S. Pat. No. 5,515,931.

A DC current of about 10 amperes supplied to guide wire 32 produces a magnetic field H measurable by a standard steering tool probe 81 and permits precise control of the drilling of borehole 60 with a spacing between adjacent boreholes of one to two meters. The drilling of borehole 60, under such conditions, can be held to an accuracy of plus or minus 0.1 meter. This kind of accuracy ensures that the injected sealing material from adjacent parallel boreholes will provide a continuous layer 47 having low permeability beneath the waste site 10.

The control instructions produced by computer 100 are transmitted downhole to the probe 81 by way of cable 32. This is accomplished by encoding the DC current in cable 32 to generate a corresponding encoded magnetic field H. This field is sensed by the magnetometer 82 or by a separate AC sensor in the probe 81 to produce corresponding control signals in a controller 116 in probe 81. The control signals are then supplied to the steering tool 78 to control the drilling. Encoding of the guide current in cable 32 can be accomplished, for example, by computer 100 through telemetry 52 to operate switch 50 to connect and disconnect the power source 51 to thereby produce a corresponding series of DC or AC pulses in cable 32. Alternatively, telemetry such as that shown for downhole package 79 may be provided at the surface. Current pulses or audio frequency signals may be supplied, for example, during the time that the drilling operation is halted for connection of a new drill stem segment.

The controller 116 responds to the timing of the pulsed currents in the guide wire 32 to carry out various functions within the probe 81 in addition to controlling the steering tool 78. For example, the controller may respond to a predetermined set of pulses to shut the probe down when it is not needed, as by turning off those functions such as telemetry 86 which consume the limited battery life. Other sequences of guidance current pulses may cause the controller to activate probe 81 and the telemetry 86 to permit transmission of magnetometer and inclinometer outputs to the surface by way of modulated-frequency currents to enable a complete set or a partial set of survey data to be sent to the surface when desired.

Thus, the cable 32 serves multiple functions for the drilling of parallel boreholes for a wide range of purposes. The cable provides an antenna sending control signals to the sonde 78 and for receiving telemetry signals from the probe 81. In addition, currents on the cable provide drilling guidance for producing multiple parallel boreholes for use in producing impervious membranes, as described above.

Figure 9:
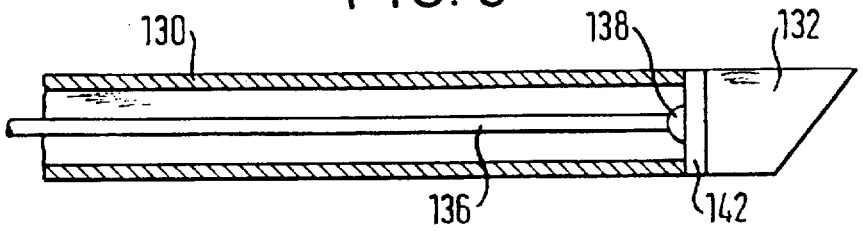
FIG. 9. is a diagrammatic illustration of a data telemetry system incorporating the guide cable and steering tool probe of the invention.
Figure 10:
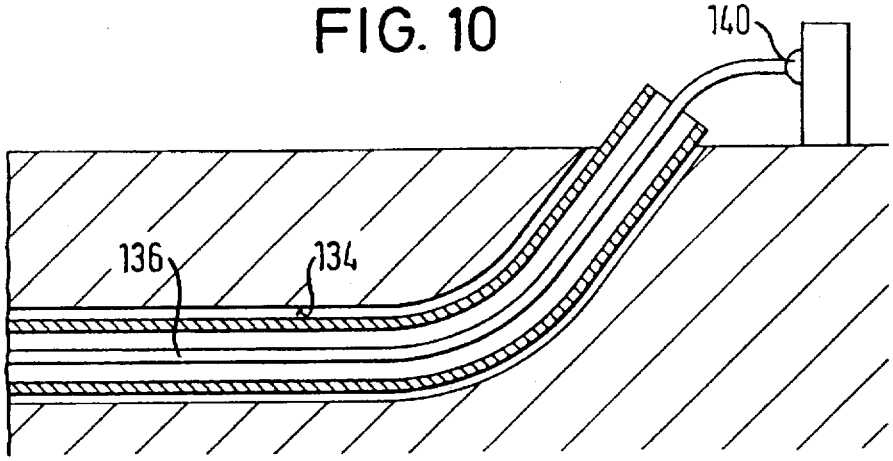
FIG. 10 is a diagrammatic partial view of the embodiment of FIG. 9, with the guide cable being secured at the Earth's surface.

An alternative embodiment of the invention is illustrated in FIGS. 9 and 10, wherein a drill stem 130 having a drill head 132 is used not only to drill a borehole 134, but to place a guide cable 136 into the borehole. The guide cable is positioned inside the hollow drill stem, and is secured to the stem at the leading end thereof. For example, the cable may be secured to the drill head 132 as by a fixture 138. The cable is drawn into the borehole 134 as the hole is drilled, with additional sections of the stem being slipped over the cable as needed. The cable may be used as an umbilical to carry drilling control signals, and when the borehole is complete, as illustrated in FIG. 10, the drill head 132 may be removed, the cable 136 secured, as at fixture 140, and the stem 130 withdrawn from the cable. This leaves the guide cable in place in the borehole for later use as a reference to guide the drilling of later holes, as described above for cable 32.

It will be apparent that numerous variations of this embodiment are available. For example, the drill head 132 need not be removed if the cable 136 is extended through an opening on the drill face. This would allow the drill head to be converted to an injection head to inject a barrier material into the Earth as the drill stem is withdrawn, as described above, while allowing the cable to pass through the aperture. Further, although the package 79 (FIG. 8) is not illustrated in detail in this embodiment, it will be apparent that such a package may be incorporated, as generally indicated at 142, for controlling the drilling operation.

Figure 11:
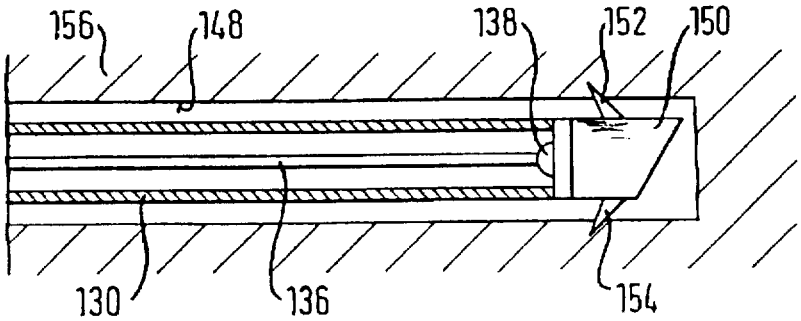
FIG. 11 is a diagrammatic view of an alternative embodiment, wherein a guide cable is placed in a blind borehole.

Although FIG. 10 illustrates the drill stem extending out of the borehole 134 to provide access to the end of cable 136, a guide cable can also be provided in a blind borehole 148, as illustrated in FIG. 11. As there shown, drill stem 130 carries at its forward end a drill head 150 to which the cable 136 is secured, as described above. In this case, however, the drill head includes a pair of pivotally mounted anchors 152 and 154 which are normally folded into the drill head. However, when the drill head reaches a preselected location, or depth, the anchors may be released, as by a small explosive charge, to cause them to swing outwardly and become embedded in the Earth 156. The drill head 150 is then released from the end of the drill stem 130 and the stem is withdrawn. The anchors 152 and 154 hold the drill head in place in the borehole so that the cable is retained in the hole as the stem is withdrawn. The cable may then be used to produce a guide field, as described above.

It will be apparent that the cable may be secured to a releasable anchor section of the drill head, rather than to the drill head itself, if desired, so that the drill head can be removed from the borehole with stem 130, while leaving the cable and anchor section is place.

Figure 12:
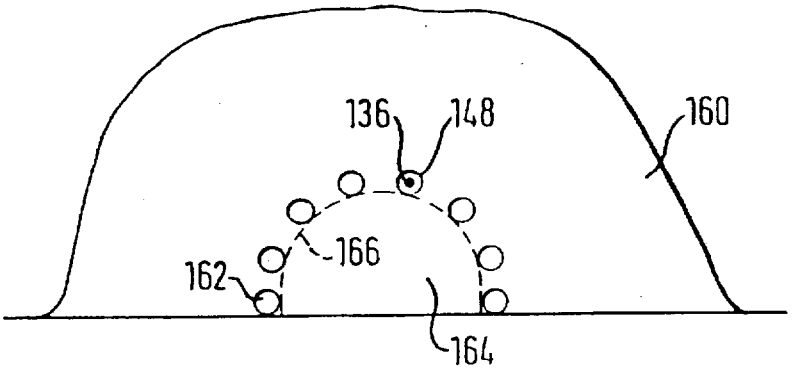
FIG. 12 is a diagrammatic view of a tunnel utilizing the borehole of FIG. 11.

The blind hole system of FIG. 11 may be used, for example, when drilling a tunnel into the side of a hill such as that indicated at 160 in FIG. 12, and when only one section of the length of the tunnel is to be constructed at a time. In such an example, multiple parallel, spaced boreholes 162 are drilled around and at equal distances from the center of the tunnel, in the manner illustrated in FIG. 12, with the cable 136 in the initial tunnel 148 (FIG. 11) being used to guide the drilling of the parallel tunnels. The boreholes 148 and 162 may be filled with a support material such as concrete, for example, and the center 164 of the tunnel excavated. Thereafter, a second set of blind boreholes may be drilled inside the circumference 166 of the tunnel to construct the next segment of the tunnel.

Although the present invention has been described in terms of preferred embodiments, it will be apparent that variations and modifications may be made without departing from the true spirit and scope thereof. Thus, for example, although the steering system and method of the invention may find its primary use in drilling parallel boreholes, it may in some cases be desirable to drill converging, diverging, or even intersecting boreholes. The system of the invention is capable of controlling such boreholes. Thus, the invention is limited only by the following claims.

What is claimed is:

1. A method of drilling parallel, generally horizontal boreholes, comprising:

drilling a first borehole from an entrance location to an exit location;

pulling a guide cable into said first borehole while withdrawing the drill string used to drill the first borehole;

supplying a first guide current to said guide cable to produce a first magnetic field surrounding the guide cable;

drilling a second borehole within said magnetic field;

measuring selected parameters including parameters of said first magnetic field within said second borehole;

producing a second current in said second borehole and modulating said second current in accordance with the measured parameters to produce a corresponding modulated second magnetic field;

detecting said modulated second magnetic field at said guide cable to produce in said guide cable a third current corresponding to said measured parameters;

determining from said measured parameters the distance and direction from one of said boreholes to the other of said boreholes; and controlling the direction of drilling of said second borehole in accordance with said determined distance and direction.

2. The method of claim 1, wherein determining distance and direction includes detecting said third current at a surface location and calculating from said measured parameters said distance and direction.

3. The method of claim 2, further including modifying said first guide current to control the measurement of parameters in said second borehole.

4. The method of claim 2, wherein producing said second current includes providing frequency current in said second borehole, said first audio frequency current being modulated in accordance with said measured parameters.

5. Telemetry apparatus for parallel boreholes, comprising:

a first borehole having an entrance location;

a guide cable in said first borehole, said guide cable extending from said entrance location a predetermined distance into said first borehole;

a source of current connected to said guide cable for producing a guide current in said guide cable and a corresponding magnetic guide field surrounding said cable;

a drill stem for drilling a second borehole within said magnetic guide field;

a sensor probe in said drill stem responsive at least to said magnetic guide field to produce output data signals corresponding to said magnetic guide field;

a transmitter within said drill stem connected to said sensor probe for transmitting said data signals from said sensor to said guide cable; and means connected to said guide cable for receiving said data signal for use in controlling said drill stem.

6. The apparatus of claim 5, wherein said drill stem includes first and second electrically conductive segments joined by an electrically insulating joint, said drill stem transmitter being connected between said first and second segments to produce a transmitter current in said drill stem, and wherein said sensor probe data signals modulate said transmitter current in accordance with said magnetic field to transmit said data signals to said guide cable.

7. The apparatus of claim 6, wherein said drill stem transmitter is an audio frequency transmitter.

8. The apparatus of claim 6, wherein said sensor probe includes a magnetometer responsive to said magnetic field, and further includes an inclinometer responsive to gravity.

9. The apparatus of claim 8, wherein said drill stem transmitter is an audio frequency transmitter modulated to produce said first current in accordance with data signals produced by measurements of said magnetic field by said magnetometer and in accordance with measurements of gravity by said inclinometer.

10. The apparatus of claim 9, wherein said transmitter current in said drill stem induces a corresponding modulated voltage in said guide cable, and wherein said means for receiving said data signals includes a receiver connected to said guide cable at said entrance location.

11. The apparatus of claim 10, further including a guide cable transmitter connected to said guide cable at said entrance location for modulating said guide current.

12. The apparatus of claim 11, further including control means producing control signals for modulating said guide current for controlling said drill stem transmitter.

13. The apparatus of claim 5, further including an anchor releasable to secure said guide cable within said first borehole.

14. The apparatus of claim 13, further including a cable placement drill stem for drilling said first borehole, said guide cable extending through said cable placement drill stem and being secured to said anchor, and wherein said anchor retains said guide cable in said first borehole as said drill stem is withdrawn.

15. A method for producing substantially parallel boreholes, comprising:

drilling a first borehole through the Earth using drilling equipment;

pulling a guide cable into said first borehole by means of said drilling equipment simultaneously with drilling said first borehole for use in providing a reference magnetic field;

retaining said cable in said first borehole as said drilling equipment is withdrawn, and drilling a second borehole guided by said magnetic field.

16. The method of claim 15, further including connecting said guide cable to a source of current to thereby produce a corresponding magnetic field surrounding said borehole.

17. The method of claim 16, further including repetitively drilling additional boreholes guided by the magnetic field produced by current supplied to the guide cable pulled into previously-drilled holes.

18. The method of claim 16, wherein drilling said second borehole includes:

sensing vector components of the magnetic field produced by said current in said guide cable;

determining from said vector components the distance and direction from said second borehole to said guide cable; and controlling the drilling of the second borehole along a path with respect to said first borehole.

19. The method of claim 18, wherein determining distance and direction includes transmitting said vector component signals to surface equipment.

20. The method of claim 15, further including:

drilling said first borehole from an entrance location to an exit location;

supplying a guide current to said guide cable to produce a magnetic field surrounding the guide cable;

drilling at least a portion of said second borehole within said magnetic field;

determining the distance and direction to said first borehole from said second borehole; and controlling the direction of drilling of said second borehole in accordance with said determined distance and direction.

21. The method of claim 20, wherein determining distance and direction includes measuring selected parameters within said second borehole and transmitting data from said measurements to a surface location.

22. The method of claim 21, further including modifying said current to control the measurement of parameters in said second borehole.

23. The method of claim 21, further including modifying said current to control the transmission of data representing said parameters to said surface location.

24. The method of claim 21, wherein transmitting data includes:

producing a first audio frequency current in said second borehole;

modulating said first audio frequency current in accordance with measured parameters;

detecting, at said guide cable, magnetic fields produced by said first audio frequency current to produce a corresponding second audio frequency current in said guide cable; and detecting said second audio frequency current at said surface location.

25. The method of claim 15, further including injecting sealing material into the soil in the region of the boreholes so as to produce a continuous barrier layer.

26. Telemetry apparatus for borehole, comprising:

a drill stem for drilling a borehole;

a sensor probe within said drill stem for producing data signals to be transmitted;

a drill stem transmitter responsive to said data signals to produce a corresponding first magnetic field;

a telemetry cable within and responsive to said first magnetic field to produce corresponding magnetically induced voltages; and a receiver connected to said cable to detect said voltages.

27. The apparatus of claim 26, wherein said drill stem transmitter is an audio frequency transmitter.

28. The apparatus of claim 26, wherein said drill stem includes first and second electrically conductive segments joined by an electrically insulating joint, said drill stem transmitter being connected between said first and second segments to produce a first current in said drill stem, said sensor probe data signals modulating said first current to thereby modulate said first magnetic field.

29. The apparatus of claim 28, wherein said sensor probe includes a magnetometer responsive to magnetic fields surrounding said probe, and further includes an inclinometer responsive to gravity.

30. The apparatus of claim 29, wherein said drill stem transmitter is an audio frequency transmitter modulated to produce said first current in accordance with measurements of said magnetic fields by said magnetometer and in accordance with measurements of gravity by said inclinometer.

31. The apparatus of claim 30, wherein said first current in said drill stem induces corresponding modulated voltages in said telemetry cable.

32. The apparatus of claim 26, further including a telemetry cable transmitter connected to said telemetry cable for producing a guide current in said cable and a corresponding guide magnetic field surrounding said cable, said sensor probe being responsive to at least said guide magnetic field to produce said data signals.

33. The apparatus of claim 32, further including control means for producing control signals for modulating said guide current and guide magnetic field for controlling said drill stem transmitter.

* * * * *